US008401923B1

(12) United States Patent
Lester et al.

(10) Patent No.: US 8,401,923 B1
(45) Date of Patent: Mar. 19, 2013

(54) METHOD FOR A TICKET EXCHANGE ACROSS DIFFERENT SYSTEMS OF RECORD

(75) Inventors: Jay S. Lester, Newton, MA (US); Erik J. Sjogren, Decatur, GA (US)

(73) Assignee: Transengine Technologies, LLC, Newton, MA (US)

( * ) Notice: Subject to any disclaimer, the term of this patent is extended or adjusted under 35 U.S.C. 154(b) by 0 days.

(21) Appl. No.: 13/464,089

(22) Filed: May 4, 2012

(51) Int. Cl.
*G06Q 30/00* (2006.01)

(52) U.S. Cl. ..... 705/26.41; 705/26.44

(58) Field of Classification Search ..... 705/37, 705/26.1, 26.41, 26.63, 5, 26.44
See application file for complete search history.

(56) References Cited

U.S. PATENT DOCUMENTS

| | | | | |
|---|---|---|---|---|
| 5,077,665 | A | 12/1991 | Silverman et al. | |
| 5,136,501 | A | 8/1992 | Silverman et al. | |
| 5,151,692 | A | 9/1992 | Hirahara | |
| 5,237,499 | A | 8/1993 | Garback | |
| 5,255,184 | A | 10/1993 | Hornick et al. | |
| 5,581,461 | A | 12/1996 | Coll et al. | |
| 5,621,797 | A | 4/1997 | Rosen | |
| 5,640,569 | A | 6/1997 | Miller et al. | |
| 5,664,115 | A | 9/1997 | Fraser | |
| 5,710,887 | A | 1/1998 | Chelliah et al. | |
| 5,717,989 | A | 2/1998 | Tozzoli et al. | |
| 5,724,520 | A | 3/1998 | Goheen | |
| 5,835,896 | A | 11/1998 | Fisher et al. | |
| 5,905,975 | A | 5/1999 | Ausubel | |
| 6,023,685 | A | 2/2000 | Brett et al. | |
| 6,067,532 | A | 5/2000 | Gebb | |
| 6,119,229 | A * | 9/2000 | Martinez et al. | 726/28 |
| 6,151,588 | A | 11/2000 | Tozzoli et al. | |
| 6,240,396 | B1 | 5/2001 | Walker et al. | |
| 6,308,159 | B1 | 10/2001 | Strohl | |
| 6,490,567 | B1 | 12/2002 | Gregory | |
| 6,493,683 | B1 | 12/2002 | David et al. | |
| 6,496,809 | B1 | 12/2002 | Nakfoor | |
| 6,574,608 | B1 | 6/2003 | Dahod et al. | |
| 6,658,390 | B1 | 12/2003 | Walker et al. | |
| 6,704,713 | B1 | 3/2004 | Brett | |
| 6,907,405 | B2 | 6/2005 | Brett | |
| 7,003,485 | B1 | 2/2006 | Young | |
| 7,080,050 | B1 | 7/2006 | Himmelstein | |
| 7,133,835 | B1 | 11/2006 | Fusz et al. | |
| 7,246,072 | B2 | 7/2007 | Walker et al. | |

(Continued)

FOREIGN PATENT DOCUMENTS

WO WO-96/34356 A1 10/1996

OTHER PUBLICATIONS

Apr. 2010—http://web.archive.org/web/20100413223709/http://www.swapmyticket.co.uk/how_it_works/index.asp.*

*Primary Examiner* — Matthew Zimmerman
(74) *Attorney, Agent, or Firm* — Wilmer Cutler Pickering Hale and Dorr LLP

(57) ABSTRACT

In one aspect, the present disclosure relates to method for exchange of semi-fungible goods or services. In some embodiments, the method includes electronically receiving a plurality of offers from a plurality of participant devices, each offer comprising a plurality of parameters related to the offer, including an identification of a semi-fungible good or service to be offered, matching two of the offers from the plurality of participant devices based on the parameters of the offers, and executing an exchange of the semi-fungible goods or services identified in the offer, based on the parameters of the offers. In some embodiments, the semi-fungible goods or services can be tickets, reservations, services, order in line, educational services, or physical objects.

17 Claims, 18 Drawing Sheets

U.S. PATENT DOCUMENTS

| | | | | |
|---|---|---|---|---|
| 7,330,826 | B1 | 2/2008 | Porat et al. | |
| 7,418,422 | B2 | 8/2008 | Burns | |
| 7,440,918 | B2 | 10/2008 | Boyle et al. | |
| 7,447,655 | B2 | 11/2008 | Brumfield et al. | |
| 7,454,361 | B1 | 11/2008 | Halavais et al. | |
| 7,574,375 | B1 | 8/2009 | Fraser et al. | |
| 7,587,370 | B2 | 9/2009 | Himmelstein | |
| 7,647,269 | B2 | 1/2010 | Brett | |
| 7,664,663 | B2 | 2/2010 | Halavais et al. | |
| 7,680,726 | B2 | 3/2010 | Himmelstein | |
| 7,698,210 | B2 | 4/2010 | Brett | |
| 7,747,507 | B2 | 6/2010 | Brett | |
| 7,769,673 | B2 | 8/2010 | Brett | |
| 7,881,954 | B2 | 2/2011 | Halavais et al. | |
| 7,908,207 | B2 | 3/2011 | Boyle et al. | |
| 7,921,038 | B2 | 4/2011 | Matsuda et al. | |
| 7,949,595 | B2 | 5/2011 | Sussman et al. | |
| 7,979,291 | B2 | 7/2011 | Sussman et al. | |
| 8,005,744 | B2 | 8/2011 | Hamor | |
| 8,046,247 | B2 | 10/2011 | Walker et al. | |
| 2001/0049651 | A1 | 12/2001 | Selleck | |
| 2002/0026429 | A1 | 2/2002 | Lostis et al. | |
| 2002/0082969 | A1 | 6/2002 | O'Keeffe et al. | |
| 2002/0156715 | A1* | 10/2002 | Wall et al. | 705/37 |
| 2003/0069827 | A1* | 4/2003 | Gathman et al. | 705/37 |
| 2003/0093306 | A1 | 5/2003 | Onoyama | |
| 2003/0093387 | A1 | 5/2003 | Nakfoor | |
| 2003/0236736 | A1* | 12/2003 | Harmon et al. | 705/37 |
| 2004/0006497 | A1* | 1/2004 | Nestor et al. | 705/5 |
| 2004/0111303 | A1 | 6/2004 | Francis | |
| 2004/0153374 | A1 | 8/2004 | Nelson | |
| 2004/0220821 | A1 | 11/2004 | Ericsson et al. | |
| 2005/0021450 | A1 | 1/2005 | Nakfoor | |
| 2005/0091142 | A1* | 4/2005 | Renton et al. | 705/37 |
| 2005/0144115 | A1 | 6/2005 | Brett | |
| 2006/0108418 | A1 | 5/2006 | Rice | |
| 2007/0022042 | A1 | 1/2007 | Nishi | |
| 2008/0103801 | A1 | 5/2008 | Leach et al. | |
| 2008/0109321 | A1* | 5/2008 | Leach et al. | 705/26 |
| 2009/0083137 | A1 | 3/2009 | Tsai et al. | |

* cited by examiner

140

PARTICIPANT DATABASE

| ID 300 | FIRST 301 | LAST 302 | ADDRESS_LINE_1 303 | CARD_NUM 304 |
|---|---|---|---|---|
| 1111 | Jane | Johnson | 555 Main Street | XXXXXXXXXX |
| 1112 | Adam | Smith | 20 Forest Drive | XXXXXXXXXX |
| 1113 | Sue | Becker | 15 Circular Way, #10F | XXXXXXXXXX |

FIG 3A

130

INVENTORY DATABASE

| PRODUCT ID 310 | OWNER ID 311 | EXPIRES 312 | FIELD_1 313 | FIELD_2 314 |
|---|---|---|---|---|
| 77003 | 210122 | 8/15/14 | AISLE SEAT | ROW 12 |
| 77004 | 642653 | 4/1/13 | WINDOW SEAT | ROW 16 |
| 77005 | 594323 | 10/1/15 | MIDDLE SEAT | ROW 44 |
| 77006 | 7682342 | 6/2/15 | AISLE SEAT | ROW 2 |

FIG 3B

140

PARTICIPANT DATABASE

| | | |
|---|---|---|
| ID | 701 | 111-222-333 |
| FIRST | 702 | Sue |
| LAST | 703 | Smith |
| FUNDS_ACCT | 704 | PAYPAL |
| ACCT_NUMBER | 705 | ******* |
| AIRLINE_ACCT | 706 | NewJet |
| AIRLINE_NUMBER | 707 | ******* |
| E-MAIL | 708 | sue@students.edu |
| PASSWORD | 709 | ******* |

FIG 7A

130

INVENTORY DATABASE

| | | |
|---|---|---|
| SEAT POSITION | 711 | Window |
| SEAT ROW | 712 | 12 |
| CARRIER | 713 | NewJet |
| ORIGIN | 714 | New York (JFK) |
| DESTINATION | 715 | London (LHR) |
| DEPARTURE DATE | 716 | 9/1/2020 |
| FLIGHT NUMBER | 717 | 123 |
| SYSTEM OF RECORD | 718 | NewJet |

FIG 7B

120

OFFER DATABASE

| | | |
|---|---|---|
| SEAT POSITION | 721 | Any |
| SEAT ROW | 722 | Any |
| CARRIER | 723 | Any |
| ORIGIN | 724 | New York (JFK) or New York (LGA) |
| DESTINATION | 725 | London (LHR) |
| DEPARTURE DATE | 726 | 8/30/2020 – 9/2/2020 |
| FLIGHT NUMBER | 727 | Any |
| EXIT ROW | 728 | Any |
| BID | 729 | None |
| ASK | 730 | $150 |
| PREFERENCE | 731 | AUTO-PROCESS |

FIG 7C

140

PARTICIPANT DATABASE

| | | |
|---|---|---|
| ID | 741 | 00010 |
| FIRST | 742 | Travis |
| LAST | 743 | Traveler |
| FUNDS_ACCT | 744 | Visa |
| ACCT_NUMBER | 745 | ******* |
| AIRLINE_ACCT | 746 | BigJet |
| AIRLINE_NUMBER | 747 | ******* |
| E-MAIL | 748 | Travis@BigTraveler.com |
| PASSWORD | 749 | ******* |

FIG 7D

130

INVENTORY DATABASE

| | | |
|---|---|---|
| SEAT POSITION | 751 | Middle |
| SEAT ROW | 752 | 47 |
| CARRIER | 753 | BigJet |
| ORIGIN | 754 | San Francisco (SFO) |
| DESTINATION | 755 | New York (JFK) |
| DEPARTURE DATE | 756 | 5/1/2015 |
| FLIGHT NUMBER | 757 | 50 |
| SYSTEM OF RECORD | 758 | BigJet |

FIG 7E

120

OFFER DATABASE

| | | |
|---|---|---|
| SEAT POSITION | 761 | Aisle |
| CARRIER | 762 | BigJet |
| FLIGHT NUMBER | 763 | 50 |
| DEPARTURE DATE | 764 | 5/1/2015 |
| BID | 765 | 2,500 BigJet miles |
| PREFERENCE | 766 | AUTO PROCESS |

FIG 7F

120

OFFER DATABASE

| | | |
|---|---|---|
| SEAT POSITION | 771 | Aisle or Window |
| CARRIER | 772 | BigJet |
| FLIGHT TIME | 773 | 05:00:00 – 23:59:00 |
| DEPARTURE DATE | 774 | 5/1/2015 |
| ASK | 775 | $700 |
| PREFERENCE | 776 | MANUALLY REVIEW |

FIG 7G

COMPANY A

| TIME PERIOD 900 | ADVANCE ORDERS 905 | DEMAND 910 | OVER(UNDER) 915 |
|---|---|---|---|
| P1 | 100 | 250 | (150) |
| P2 | 200 | 250 | (50) |
| P3 | 300 | 250 | 50 |
| P4 | 400 | 250 | 150 |
| TOTAL | 1,000 | 1,000 | 0 |

940

945

COMPANY B

| TIME PERIOD 920 | ADVANCE ORDERS 925 | DEMAND 930 | OVER(UNDER) 935 |
|---|---|---|---|
| P1 | 300 | 200 | 100 |
| P2 | 300 | 200 | 100 |
| P3 | 300 | 200 | 100 |
| P4 | 300 | 200 | 100 |
| TOTAL | 1,200 | 800 | 400 |

FIG 9

METHOD FOR A TICKET EXCHANGE ACROSS DIFFERENT SYSTEMS OF RECORD

CROSS REFERENCES TO RELATED APPLICATIONS

This application is related to the following application, filed concurrently herewith, the entire contents of which are incorporated herein by reference:

U.S. patent application Ser. No. 13/464,179, filed on May 4, 2012, entitled "Method and System for a Continuous Exchange Driven Reallocation of Semi-Fungible Goods and Services."

BACKGROUND

Markets exist for the purpose of exchange, allowing participants to achieve higher states of utility or satisfaction by enabling a reallocation of resources. Some markets do this effectively, resulting in a final state where buyers are closely matched with the products they most desire and sellers generate maximum revenues. Large, liquid public stock exchanges often work this way. During each trading session, buyers and sellers are able to effectively exchange stocks at mutually agreed upon price points. Buyers who most value any given stock are generally able to purchase it from sellers who least value the same stock. Following a successful exchange, both parties have achieved their goals and are better off.

The simpler the product being exchanged, the easier it is for this type of ideal product reallocation to occur. Consider markets that contain identical products. These products can be more precisely referred to as fungible; that is, all of the products are completely substitutable. For example, there is no practical difference between one ounce of gold and another ounce of gold. Services can also be fungible. For example, the services of a public notary are generally viewed as substitutable for that of any other public notary.

Markets for fungible products tend to work well due to the certainty about the product being exchanged. Consider the market for gold. The owner of a gold mine does not need to consider the price of each ounce of gold they sell. Likewise, a jewelry manufacturer in the market for gold does not need to decide which mine each individual ounce of gold comes from. The value and price of gold are set by the marketplace itself and is known by all participants. This simplicity makes it easy for buyers and sellers to transact.

In contrast to markets for fungible products, markets for complex products may result in product allocations that are far from optimal. In such a market, it may be difficult for buyers and sellers to effectively communicate the variety of differences associated with each individual product, and, as a result, buyers may be challenged to find and purchase their preferred product. Some buyers may settle for inferior, but acceptable, products. As a result, sellers will earn less revenue than they otherwise would have. Buyers may also leave the marketplace entirely, resulting in a poor outcome for all parties. These sub-optimal results rarely occur in fungible markets but are commonplace in complex markets.

One type of complex marketplace is the market for semi-fungible products. Semi-fungible products are goods or services that are somewhat interchangeable but not precisely alike. An example of a semi-fungible market is the market for personal transportation. While all tickets for a seat on an airplane between Washington D.C. and New York may provide the same basic product; namely, transportation between the two cities, the value of a first class ticket may be many times that of a coach ticket. Extending our market definition beyond air transportation, the price of a bus ticket between these two cities may be only a small fraction of the cost of our coach plane seat despite the fact that the same basic service is still being provided. In this type of market, participants frequently may have difficulty identifying and obtaining the product they most desire, resulting in a sub-optimal allocation of products.

If the participants of a complex market are sufficiently dissatisfied with the initial product allocation, a secondary market may be created. These markets may be organized, or may be spontaneous and informal. In either case, the goal of a secondary market is to identify product reallocation opportunities that were not achieved by the primary market.

While secondary markets address sub-optimal product allocation, they often face the same challenges as primary markets, and there may be additional challenges that further limit their effectiveness. In some cases, industry-specific technology or governmental regulation require the creation of a formalized market infrastructure. This is the case with air transportation, lodging, and financial instruments. In other cases, secondary markets are easily imbalanced by supply and demand dynamics. A scalper with too many tickets to sell prior to the start of an event is unlikely to spend any significant time buying additional tickets, even if the pricing were extremely favorable.

Secondary markets may also be inefficient with respect to buyers who wish to exchange their product for one that they find more attractive. To accomplish this, a buyer may often need to participate in two distinct transactions. They must sell the product they originally purchased in the primary market and then buy a product they prefer in the secondary market. This two-step process introduces an additional risk: if a buyer is unable to complete one of the two transactions, they may find themselves with two products instead of one, or with no products at all.

The prior art identifies a number of inefficiencies that exist in markets for semi-fungible products. Previous attempts at improving these markets can be grouped into three categories:

1. The enhancement of existing markets through technology
2. The introduction of new secondary markets
3. The introduction of new primary markets The first category of prior art enhances existing markets by introducing new technology to improve efficiency, speed, and cost. U.S. Pat. No. 6,574,608 to Dahod et al. describes a buyer-driven system of commerce. It improves historical buyer-driven processes such as newspaper want ads by leveraging the efficiency of electronic platforms. However, this approach does not provide for the direct exchange of products between two market participants. U.S. Pat. No. 7,447,655 to Brumfield et al. introduces a methodology for automated short term electronic trading. Brumfield's concept may increase the potential speed at which participants may engage in trading, but also remains constrained by market transactions which involve only buying or selling a given object. While this first category of prior art may serve to increase market efficiency, it does not directly address the need for a new approach that allows for mutually beneficial product exchanges.

The second category of prior art introduces new secondary markets that seek to improve upon historical methods. U.S. Pat. No. 8,046,247 to Walker et al. describe a method by which sellers can reclaim and resell their products when demand increases. This approach may increase seller profits, but requires that buyers give up their original right to the purchased product. U.S. Pat. No. 6,067,532 to Gebb describes a method by which purchased products that are no longer desired can be offered up for resale. This approach may create additional value for the buyer who regrets their purchase, but does not address buyers who do not wish to relinquish ownership of their purchased product. U.S. Pat. No. 7,680,726 to Himmelstein describes a method for bartering securities electronically via the creation of potentially tax-advantaged "Himmelstein Options". This approach may allow for the barter of various financial securities, but does not address the requirements or approach required for the exchange of non-financial semi-fungible products.

The third category of prior art attempts to improve upon the primary market mechanism. U.S. Pat. No. 7,769,673 to Brett proposes an auction-driven system that generate selling prices theoretically closer to the true market value of each product being sold, thus improving upon the sub-optimal allocation common in complex markets. U.S. Pat. No. 7,908,207 to Boyle et al. allows for the aggregation of demand in a reverse auction market, thereby improving the expected outcomes for participating buyers.

This third category of prior art may improve the functioning of complex primary markets, but, by definition, all post-primary market dynamics are outside the scope of these techniques. Over time, the preferences of market participants may shift and new participants may enter the market. What might be an optimal outcome for a primary market at one point in time may be an extremely poor outcome a short time thereafter. The more dynamic a market, the more value a secondary market may offer. In order to achieve the best possible final result, a continuous reallocation methodology that utilizes a secondary market is required.

SUMMARY

The present disclosure provides methods and systems to overcome the drawbacks to the way in which semi-fungible products are currently allocated via existing markets. This disclosure introduces a continuous secondary market mechanism that allows for the reallocation of semi-fungible products, resulting in an improvement in utility for all parties involved as well as the potential for additional revenues for market makers through transaction fees.

In one aspect, the present disclosure relates to method for exchange of semi-fungible goods or services. In some embodiments, the method includes electronically receiving a plurality of offers from a plurality of participant devices, each offer comprising a plurality of parameters related to the offer, including an identification of a semi-fungible good or service to be offered, matching two of the offers from the plurality of participant devices based on the parameters of the offers, and executing an exchange of the semi-fungible goods or services identified in the offer, based on the parameters of the offers. In some embodiments, the semi-fungible goods or services can be tickets, reservations, services, order in line, educational services, or physical objects. In some embodiments, the method includes matching at least three offers. In some embodiments, the parameters include date, time, location, loyalty account assets or money. In some embodiments, the matching and executing are performed automatically. In some embodiments, at least one of the matching or executing are performed manually.

In another aspect, the present disclosure relates to a trading system. In some embodiments, the trading system includes a participant database for storing participant information, an offer database for storing parameters related to participant offers for an exchange of semi-fungible goods or services, and a processing system configured to match offers in the offer database based on the parameters related to participant offers and execute the exchange of the semi-fungible goods or services. In some embodiments, the semi-fungible goods or services can be tickets, reservations, services, order in line, educational services, or physical objects. In some embodiments, the parameters can be date, time, location, loyalty account assets or money. In some embodiments, the matching is performed automatically. In some embodiments, the matching is performed manually. In some embodiments, the trading system includes an inventory database.

Another aspect of the present disclosure relates to a method for exchanging semi-fungible goods and services. In some embodiments, the method includes receiving information from a participant related to an offer for an exchange of semi-fungible goods or services, electronically transmitting the information to a remote server, and electronically receiving a matching offer from the remote server for the exchange of semi-fungible good or services. In some embodiments, the method includes transmitting a notification of acceptance or rejection of the matching offer to the remote server. In some embodiments, the information includes parameters related to the offer, wherein the parameters include date, time, location, loyalty account assets or money. In some embodiments, the semi-fungible goods or services include tickets, reservations, services, order in line, educational services, or physical objects. Another aspect of the present disclosure relates to a device for exchanging semi-fungible goods or services. In some embodiments, the device includes a user input module for receiving information from a participant related to an offer for an exchange of semi-fungible goods or services and a communication module for electronically communicating with a remote server to transmit the information to a remote server and receive a matching offer from the remote server for the exchange of semi-fungible good or services. In some embodiments, the device includes a phone, a computer, a kiosk, a mobile device, or a content viewer. In some embodiments, the information can be parameters related to the offer, wherein the parameters comprise date, time, location, loyalty account assets or money. In some embodiments, the semi-fungible goods or services can be tickets, reservations, services, order in line, educational services, or physical objects.

BRIEF DESCRIPTION OF THE DRAWINGS

FIG. 3A is a tabular representation of a participant database shown in FIG. 1, according to embodiments of the present disclosure.

FIG. 3B is a tabular representation of an inventory database shown in FIG. 1, according to embodiments of the present disclosure.

FIG. 7A is a tabular representation of the participant database shown in FIG. 1, according to embodiments of the present disclosure.

FIG. 7B is a tabular representation of the inventory database shown in FIG. 1, according to embodiments of the present disclosure.

FIG. 7C is a tabular representation of the offer database shown in FIG. 1, according to embodiments of the present disclosure.

FIG. 7D is a tabular representation of the participant database shown in FIG. 1, according to embodiments of the present disclosure.

FIG. 7E is a tabular representation of the inventory database shown in FIG. 1, according to embodiments of the present disclosure.

FIG. 7F is a tabular representation of the offer database shown in FIG. 1, according to embodiments of the present disclosure.

FIG. 7G is a tabular representation of the offer database shown in FIG. 1, according to embodiments of the present disclosure.

FIG. 9 is a tabular example of an exchange of semi-fungible goods between two business entities, according to embodiments of the present disclosure.

DETAILED DESCRIPTION

Figure 1:
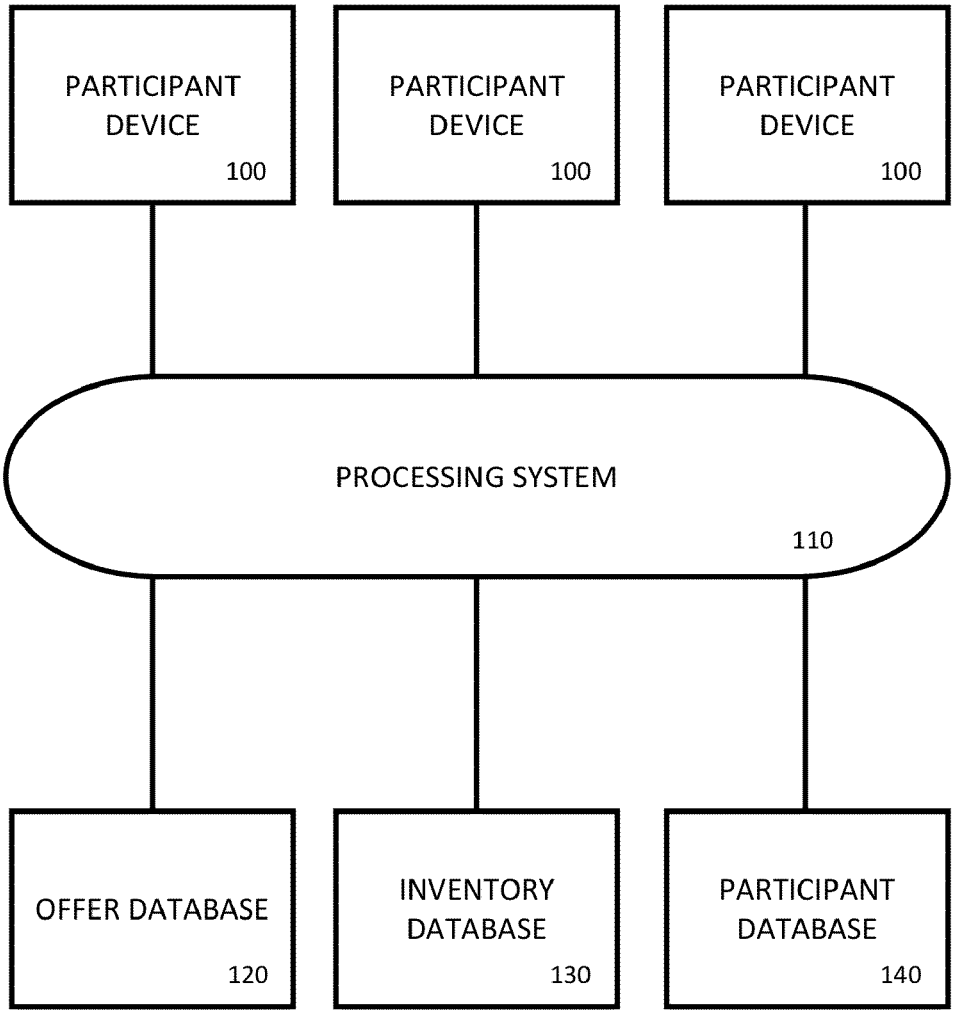
FIG. 1 is a block diagram overview of a system for exchanging semi-fungible goods and services, according to embodiments of the present disclosure.

The present disclosure is directed to systems and methods for a continuous exchange-driven reallocation of semi-fungible goods and services.

A large number of potential reallocation opportunities are not adequately addressed by secondary markets. Some examples include:

A) A businessman planning a trip finds he is only able to book an uncomfortable middle seat. He would be willing to pay $200 to get himself a more comfortable aisle seat. At the same time, a price-sensitive student travelling on the same plane has booked an aisle seat. This student is on a tight budget and would gladly exchange seats with the businessman for as little as $50. However, there is no mechanism for these two travelers to interact with each other and execute this potential exchange.

B) A family of four is traveling by express train and finds that their assigned seats are spread far apart. They would be willing to pay up to $100 to have their entire family sit together. There are a number of solo travelers on the same train who would be willing to swap seats for as little as $10. However, all of these travelers are sitting in different parts of the train and are unlikely to find each other either before or during their travels.

C) Two music fans will be attending a concert. One is on the left side of the stage and would prefer to be on the right. One is on the right side of the stage and would prefer to be on the left. They would each be willing to pay some amount to move to their preferred seating location. These two fans could consider using scalpers or resellers to try and obtain their preferred seating locations, but the effort and risk involved with this multi-step process may not be appealing, particularly if little time remains prior to the start of the concert. There is no obvious way for these two fans to find each other and exchange tickets.

D) A manufacturer has a contract to receive a ton of a rare material in January. They actually do not need it until August. A second manufacturer has a contract for a ton of the same material in August but would prefer to receive it in January. Both manufacturers would benefit from trading their advance orders but there is no market for such a transaction. The supplier may have the capability to broker such an exchange but may have little incentive to do so.

To address shortcomings in the prior art, the present disclosure introduces a system that allows a plurality of market participants to exchange semi-fungible products. There are four benefits resulting from the creation of this exchange:

1. Exchange participants can upgrade aspects of their product that they value more.
2. Exchange participants can monetize aspects of their product that they value less.
3. Market efficiency may be improved, particularly when supply and demand disruptions limit normal market liquidity.
4. Market makers may generate additional revenues through transaction fees.

Exploring each of these benefits in turn, let us first examine the case where a market participant wishes to upgrade some aspect of their current product. This type of participant has purchased a product that they value, but they are not fully satisfied with their purchase. Consider the business traveler who has purchased a middle seat on a plane. As a price-insensitive business traveler, he may be willing to pay significantly more for a more comfortable aisle seat, but was unable to obtain one in the primary market. By enabling this traveler to exchange his seat for one that he values more, his overall satisfaction can be increased.

Product upgrades can encompass more than one dimension. Our business traveler may be willing to adjust several aspects of his purchased product to realize the best possible outcome. In order to achieve his primary objective of travelling in a more comfortable manner, he may be willing to fly earlier in the day, utilize a different transportation provider, arrive at a different airport, or even exchange his seat for an alternative form of transport such as express train or limousine service.

When compensation is involved in an exchange, it need not be limited to currency. While our business traveler may wish to directly bundle a certain amount of money with his middle seat to secure a product upgrade, he is free to offer any asset capable of being managed in an electronic environment. Potential alternative assets include loyalty points, airline miles, reward certificates, upgrade points, and financial instruments, all of which are routinely managed in secure modern electronic environments.

Now, consider market participants who wish to monetize certain aspects of their product. They realize that while they may not see any meaningful difference between two products, other participants may value the market differently and may be willing to pay for an exchange with them. As an example, consider a traveler sitting by herself on a train. She may see no difference between her window seat and any other window seat on the same train. However, a family looking to rearrange their seat tickets so that they can sit together may be willing to pay her $10 just to move a few rows. By participating in such a transaction, our indifferent traveler has monetized the value of her ticket without compromising the value she receives from the product.

Monetization does not require indifference to a proposed product exchange. An exchange can easily involve a perceived product downgrade as long as the compensation from the other party exceeds the perceived loss in value. Consider our train passenger once again, but now assume that the family looking to sit together would like our passenger accept a less desirable seat next to the restroom entrance. Our passenger may no longer find $10 sufficient inducement to participate in an exchange. However, there is likely some price at which our passenger would be willing to exchange her seat and feel better off than she did prior to the exchange.

In addition to creating value for market participants, the present disclosure may also benefit the functioning of the overall market by providing additional liquidity to all market participants. This effect may be most pronounced during supply or demand fluctuations, when the primary market is challenges to match buyers and sellers in the traditional manner.

To illustrate this phenomenon, consider a typical supply disruption in the airline industry: inclement winter weather in Chicago disrupts the normal hub-and-spoke airline networks, resulting in nationwide flight delays and a high risk of flight cancellations. In such an event, individual traveler preferences may drastically shift at the same time that market liquidity is restricted, creating an imbalanced market that may take several days and large sums of money to correct. Prior to the network disruption, a given individual may be perfectly satisfied with his ticket on an 8 PM flight from Chicago to Orlando. However, once weather issues begin early in the day, this passenger realized his late flight may be cancelled. Immediately, this passenger's preference set radically shifts: he is planning to attend an important event the next morning and may be willing to pay up to $1,500 in order to exchange his seat with someone leaving earlier in the day on flight less likely to be cancelled. If a passenger on the earlier flight is willing to accept this exchange, not only will both passengers be better off, but the burden on the network may be reduced since fewer passengers may require the attention of airport employees and the total system cost for rebalancing the system could be reduced. By introducing additional liquidity into a restricted system, the necessary product reallocation may be achieved more easily and efficiently.

Likewise, fluctuations in demand that drive limited market liquidity may also benefit from the present disclosure. Consider the market for a new consumer electronics product. It is not uncommon for demand on this type of product to quickly spike, far outpacing the manufacturer's ability to supply the product to the marketplace. As a result, consumers not able to purchase the product may receive vouchers that are fulfilled in sequential order. These vouchers are semi-fungible products. While all vouchers assure receipt of the desired electronic product at some point in time, the actual date of receipt will vary by voucher. Since there may be no relationship between any individual's desire for the product and the order of their voucher, an opportunity for product reallocation exists. A secondary market would allow consumers who most value early receipt of the product to pay for this right and receive the product first, while others could monetize the value of their early vouchers and receive the product at a later time.

A market that regularly suffers from a lack of liquidity may also benefit from the present disclosure. Consider the market for educational services, for example, classes at a college or university. At the start of each semester, students may vie for limited spots in any number of popular classes. As a result, when classes reach capacity, some students may find that they are not able to construct their preferred class schedule and need to enroll in classes that they otherwise would not want to take. However, at the same time, some of the students that were able to obtain spots in popular classes may actually be indifferent between taking that class and one of the less popular alternatives. These two groups of students could benefit from a secondary market that allows for product reallocation. Students that most value a certain class could exchange parts of their schedule with students that value these classes to a lesser degree. As with other markets, both individuals could potentially benefit from this exchange.

A final benefit arising from the exchange of semi-fungible products is the potential for creating a profitable market infrastructure. Requiring reasonable transaction fees for product exchanges is consistent with the way in which many markets function and reflects the real value created by the marketplace. Transaction fees may be charged to the buyer, to the seller, or both. Such fees may be flat, variable or a combination of both a flat and variable fee.

System Architecture

Turning to the drawings, FIG. 1 provides an overview of the system architecture. The system includes a number of participant devices 100 which allow interested parties to connect to the processing system 110. The participant devices may be personal computers, cell phones, mobile devices, kiosks, or any other types of communication device capable of receiving and transmitting data. The participant device does not need to be physical. It may be a virtual device, a computer program, a service offered by a website, an application run on a mobile device, or any other type of system capable of receiving and transmitting data. The processing system 110 may be a dedicated physical computer, a cloud-based virtual system, or another form of computational processor. The participant devices 100 may connect to the processing system 110 through a wireless connection, a direct wired connection, the internet using TCP/IP, a Local Area Network (LAN), a virtual private network (VPN) or any other form of communications network.

The processing system 110, in turn, connects to a number of data sources. These include an offer database 120, an inventory database 130, and a participant database 140.

These three databases may reside on the hard drive or memory of a physical server, a virtual server, a distributed computing platform, a network of computing devices spanning both dedicated servers and mobile devices, or any other form of technology capable of storing and retrieving data. These platforms can incorporate a database management systems (DBMS) to manage the databases in a structured fashion.

These databases may be structured as relational databases, parallel databases, cloud databases, data warehouses, federated databases, in-memory databases, flat files, or any other data structure that meets the needs of the particular application.

The offer database 120 contains information used to structure participant offers. These offers are composed of one or more product criteria, a compensation element, user preferences, and a link to the appropriate product in the inventory database 130. Together, these pieces of information allow the processing system 110 to identify which other offers represent potential matches. The offer database may be directly accessible by participants who wish to manually search for matching offers.

The inventory database 130 contains information about the products that are being offered for exchange by participants. This can include ownership information as well as all of the data upon which offers are created. Due to the fact that multiple offers may exist in the offer database 120 for each product in the inventory database 130, this database may follow standard, well-understood conventions that prevent a single product from being acted upon by more than one offer at a time.

Finally, the participant database 140 contains information on each market participant. This data may include elements associated with an individual participant such as name, address, billing information, security data and preferences for interacting with the processing system 110. A single market participant may be associated with any number of products and any number of offers. Sensitive data such as credit card numbers or passwords may be stored using established database encryption techniques.

In practice, it may be preferable to combine or sub-divide these databases in any number of ways to increase processing efficiency, data validity, data security or ease of maintenance. By way of example, all three databases 120, 130, 140 may be contained within the memory of the processing system 110, allowing for increased speed and efficiency. Alternatively, the databases may be further subdivided by geography, participant type, product type or some other characteristic that improves the overall performance, reliability, security, maintenance or general functioning of the system. In the case of mobile or distributed computing, it is feasible that millions of mobile devices may contain their own database that interacts with the processing system 110, and that certain functions of the processing system 110 itself may be partially or fully executed by mobile, remote or distributed devices.

Detailed Process

Figure 2:
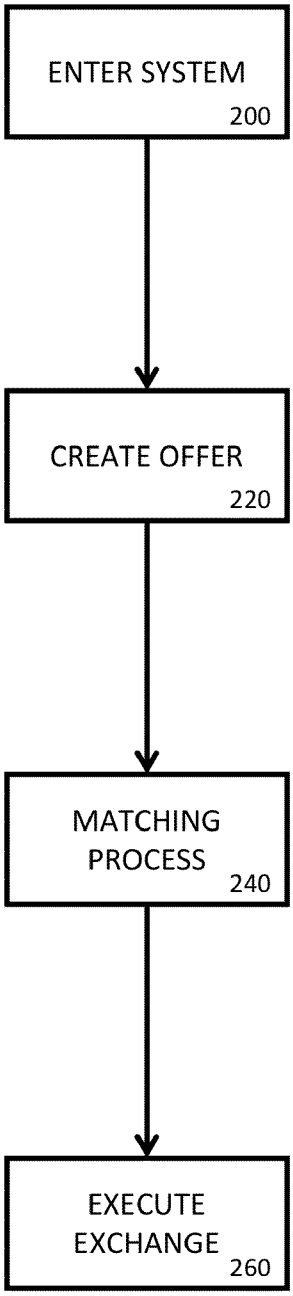
FIG. 2 is a flow chart illustrating a method of exchanging semi-fungible goods and services utilized by the processing system shown in FIG. 1, according to embodiments of the present disclosure.

FIG. 2 describes the exchange process. As a precondition, a participant must possess or have some ownership right to one or more suitable semi-fungible goods, services or priority rights, referred to hereafter as "products". Up until the product is used, consumed, sold or otherwise unavailable for exchange, a participant may enter the system 200 and create any number of offers 220. Potential matches may then be identified 240 by either the participants or the processing system 110. If a potential match is approved by all involved participants, the processing system 110 can execute a product exchange 260.

A participant enters the system 200 when they believe a potential exchange may be of benefit to them. For example, a family purchasing three airline tickets may find that their seats are too far away from each other and that there would be value in modifying one or more of their purchased tickets in order to have the family sit closer together. Conversely, another airline passenger may be completely indifferent in regards to the location of their seat and would be willing to exchange seats in return for some form of compensation.

The way in which a participant enters the system 200 can vary with the technology being utilized and the nature of the products being exchanged. One natural point of entry involves integration with the platform used to purchase the products being exchanged. For example, a website, mobile application, or kiosk that sells event tickets could allow users to enter the exchange system. This structure has the advantage of being directly connected to the system-of-record for the purchased products, thereby reducing the potential for fraud and simplifying the final systems architecture.

An alternative and equally acceptable way to enter the system 200 may involve an independent technology platform separate from any platform used to purchase the products being exchanged. This structure has the advantage of additional flexibility in terms of the breadth of products that may be exchanged. By existing as a system-independent platform, participants may be able to consider complex multi-product exchanges that offer additional value.

Information about both the participant and the product may be collected during this stage 200 and stored in the participant 140 and inventory 130 databases, respectively. Certain information may also be validated at this time to minimize the potential for later issues. For example, participant identification and product ownership may be confirmed by communicating with external data sources or by other means.

After the system is entered, a participant may then create an offer 220 based on one or more of their products. The offer creation process translates what a participant wants out of a potential exchange into structured data that can be stored in the offer database 120 and used by the processing system 110 and the participants themselves to identify potential matches. During this process, the participant may also be able to view current or historical offer data. In some cases, this may lead the participant to identify an offer they wish to immediately accept. If this occurs, the process may move directly to the product exchange process 260.

The matching process 240 provides for the identification and processing of potential offer matches. These potential matches may have been previously identified by the participants themselves during the offer creation process 220, or the system may review all existing offers to find potential matches. In either case, once a potential match is identified and agreed to by all participants, the system can then proceed to execute a product exchange 260. If no matches are found, the system can wait until a new matching offer is created by a participant, an existing order is modified in a way that allows it to match, a participant opts to directly accept an offer, the offer is cancelled or the product that the offer is based upon is no longer available for exchange.

The offer exchange process 260 begins when two or more offers are matched either by the processing system 110 or directly by participants. At this time, any required compensation processing takes place and the product exchange is accomplished by updating systems that record official ownership of the products involved. Once all systems of record have been updated, participants are notified and the exchange is complete.

FIGS. 3A and 3B illustrate exemplary types of data that may be stored in the participant database 140 and inventory database 130 after an individual has entered the system 200. The precise type and quantity of data can be specific to each product market, but may include data related to individual and product identification, security, participant preferences, and product attribute fields used during the offer matching process.

The sample participant database 140 shown in FIG. 3A illustrates a potential subset of fields that may be used to manage a participant's data. Many databases structures may assign a unique identification number 300 to each participant. Data used by the exchange process can include an individual's first name 301, last name 302, address 303, and credit card number 304. Other potential participant data includes e-mail addresses, login identifiers, login passwords, and login security questions. Ideally, any data deemed sensitive (such as credit card numbers, passwords, and security information) can be stored in a secure, encrypted manner. Non-sensitive participant data may also be used for marketing purposes.

The inventory database 130 shown in FIG. 3B illustrates a potential subset of fields that may be used to manage the data surrounding an individual product. A unique product identifier 310 may be used to uniquely identify each product in the system. An owner identifier 311 associated each product with its owner in the participant database 140. An expiration date 312 is used to limit the timeframe of an offer. This time or date may be determined by the product itself, such as the departure date associated with an airline ticket, or it may be an arbitrary date created by a participant. For example, a participant may not want to exchange her product after a certain amount of time in order to prevent last-minute changes to her travel schedule or other plans associated with the product.

The inventory database 130 can also contain a number of attribute fields that allow for the construction of detailed offers. In FIG. 3B, our sample inventory database, our first attribute field 313 describes the position of an airline seat: aisle, middle, or window. The second attribute field 314 describes the row number of an airline seat. Other potential attribute fields associated with an airline seat may include carrier, date of departure, originating airport, destination airport, and exit row status among others. Potential fields for a live event at a music venue may include the performing artist's name, the date of the event, the section number, and the row number, among others. Potential fields for other semi-fungible products will vary and are only limited by the nature of the product and the perceptive ability of involved participants.

When product data is added to the inventory database 130, some level of verification may take place to ensure that the product in question is actually owned by the participant. This verification may require explicit communication between the processing system 110 and an external system. This verification may be implicit if the product inventory data is being directly transferred by a previously verified and authorized system.

Figure 4:
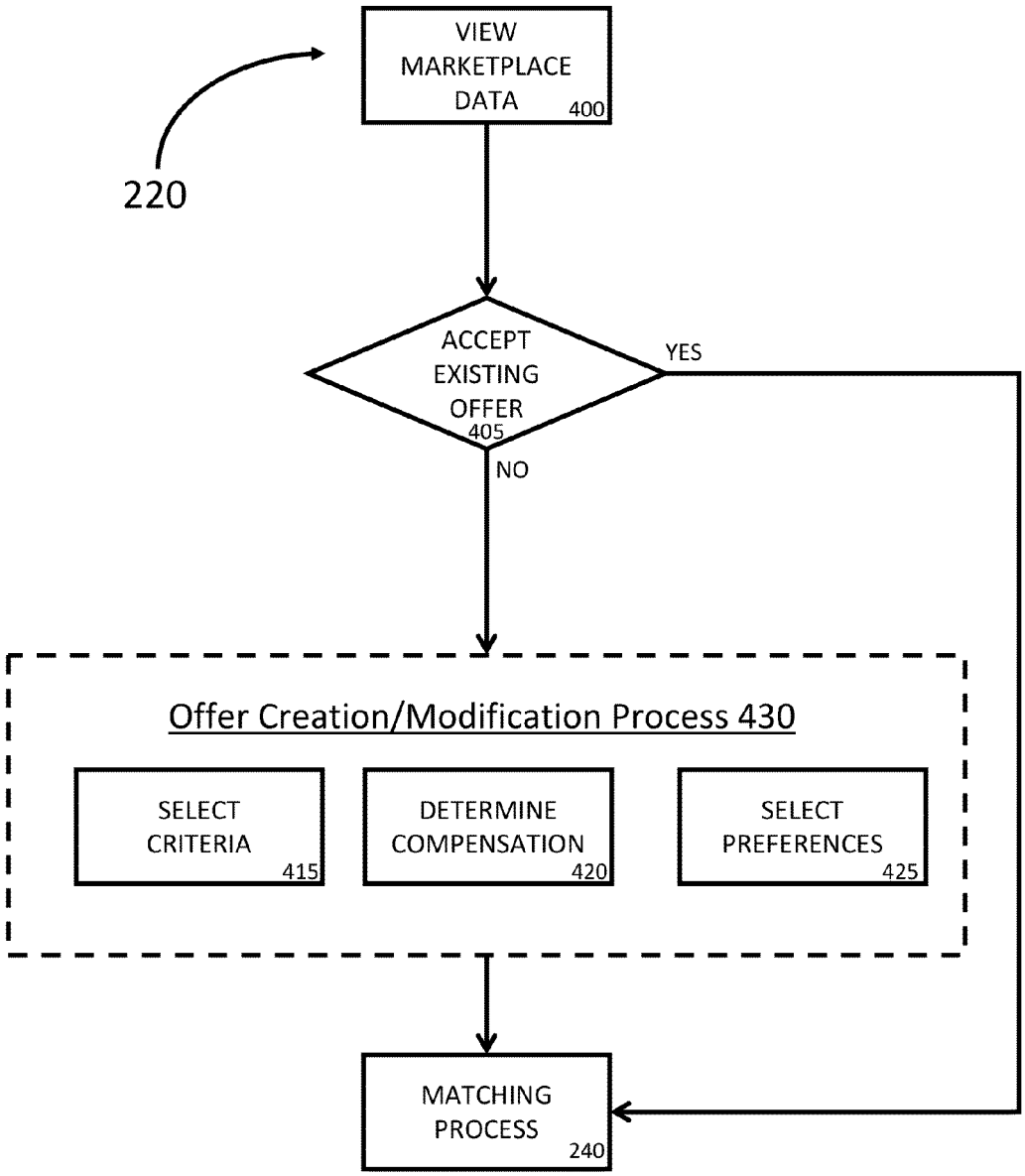
FIG. 4 is a flow chart illustrating a method for creating or modifying an offer to exchange semi-fungible goods and services, according to embodiments of the present disclosure.

FIG. 4 provides more detail on the offer creation process 220 from FIG. 2. At the start of the offer creation process, a participant may have the opportunity to view offers created by other participants 400. Collectively, these offers can be referred to as the "market" or a "marketplace". In certain embodiments, a participant may have complete visibility to all offers, while in other embodiments only a partial view may be available for reasons specific to that marketplace. In still other embodiments, participants may have access to historical data which may further enhance their ability to create effective offers.

Data helpful to a participant may include current bid and ask offers for similar products, recent volume of transactions in the product category, or historical trends in terms of both price and volume. To illustrate this, consider a music fan looking to monetize the value of their front-row concert ticket. This individual may find it helpful to know what value was attached to similar offers in the past, what bid values currently exist in the market, and if any other ask offers exist. If the participant sees that many concert goers are willing to offer more than $100 in order to exchange their less desirable tickets for his front-row location, our music fan may feel more inclined to create a new offer with an ask price well above $100.

Normally, it is to the participant's advantage to gain as much information as possible before creating an offer. There are several reasons for this. First, the participant can develop a more effective offer by evaluating current market conditions. He may find that there are already several offers that potentially match his product's attributes, but that his initial ask value is simply too high. Second, there may be offers in the marketplace that the participant may want to immediately accept, allowing him to avoid the time and effort associated with creating a new offer.

If a participant identifies an existing offer that he would like to accept, he may do so immediately 405, without the need to create an offer of his own. The system may automatically create a matching offer in the offer database 120, or may allow the process to proceed in an efficient manner with all of the information required to execute a product exchange, but without creating a matching offer in the offer database 120. In either case, if an existing offer is identified as a potential match by a participant, the process may immediately proceed to the matching process 240.

If the participant does not identify an existing offer that he wishes to accept, he may then proceed to create one or more new offers, or to modify an offer he previously created. The offer creation/modification process 430 allows participants to translate their intentions into a structured form of data that can be used by the processing system to identify potential matches. This process involves three steps. These steps can be completed in any order and may be predetermined by the market maker.

First, the criteria for an acceptable product exchange are selected 415. Consider, for example, an airline passenger with a preference for aisle seating who has unfortunately purchased a window seat. This passenger may be willing to exchange his current (window) seat for any aisle seat on the same flight. If the individual is more discerning, he may only be willing to exchange his current seat for an aisle seat in rows 8-15. On the other hand, if the individual has a particularly strong aversion to window seats, he may be willing to broaden his selection criteria to include aisle seats on flights other than his own. An individual's set of personal preferences define what type of product is acceptable on the other side of the exchange.

If the product being exchanged consists of a block of several individual items, the criteria for an acceptable exchange may include metrics that are relative in nature. In the case of a block of four event tickets, a participant may want to exchange this block only for another block of tickets that are physically next to each other. In this example, the desired seat location is relative to the other seats, not to the event venue itself. It is also possible that both relative and absolute criteria exist. For example, a participant exchanging a block of seats may desire that all seats are both next to each other and are all located in a specific location, such as on the mezzanine level.

The second step in the offer creation/modification process involves determining what form of compensation 420, if any, is included in the offer. There are three possibilities: a bid, an ask, or an even exchange. A bid offer means that the participant is willing to compensate the party on the other side of the product exchange. This implies that the participant is attempting to upgrade their product along one or more dimensions.

An ask offer means that the participant wants to receive compensation in order to accept an exchange. This may or may not involve a perceived product downgrade.

Finally, an even exchange does not involve any transfer of compensation and implies that all parties involved in an exchange possess complementary preference sets. For example, one participant may prefer aisle seats while another prefers window seats. In an even exchange, the simple act of exchanging products produces value for both participants.

The third step in the offer creation/modification process allows participants to select the degree to which they will be involved in the exchange process 425. In certain embodiments, this step may be fixed in advance or may be dictated by the nature of the market. The spectrum of involvement ranges from a completely manual process where participants review each and every potential match before the process moves forward, to a fully automated process where no participant input is required and offers are automatically reviewed and matched by the processing system 110.

A manual, participant driven review process may be preferred where the set of potential options is large and participant preferences are dynamic. For example, consider a participant looking to exchange a train reservation for a similar reservation sometime later that year. Considering that the number of potential transit-date-time combinations may be extremely large and that the participant's schedule may change over time, it may be unrealistic to try and provide a comprehensive set of preference information. In such a situation, it may be more efficient for participants to provide a limited set of criteria and then to manually review potential matches as they are identified by the processing system 110.

An automatic, system driven review process may be preferred where the set of potential options is limited and participant preferences are relatively stable over time. For example, an airline passenger looking to exchange their middle seat for an aisle or window location on the same flight may not benefit from reviewing each potential matching offer. Due to the superior speed associated with an automated review process, this approach also gives a participant the best possible chance of securing a match quickly. Consider two participants with identical preferences and identical products. If one participant agrees to an automatic review process and the other participant opts to manually review each and every potential match, the automatic process should be expected to obtain a desired match first.

Additionally, an automatic, system driven review process allows for multiple party exchanges that may not be practical or even possible with a manual review system.

In practice, a participant may choose to take advantage of both automated and manual review processes by creating multiple offers. Automatic, system driven offers can identify clearly favorable circumstances that do not require further review by the participant. At the same time, manual offers may capture a wider spectrum of potential matches that will require further consideration before being accepted.

Figure 5:
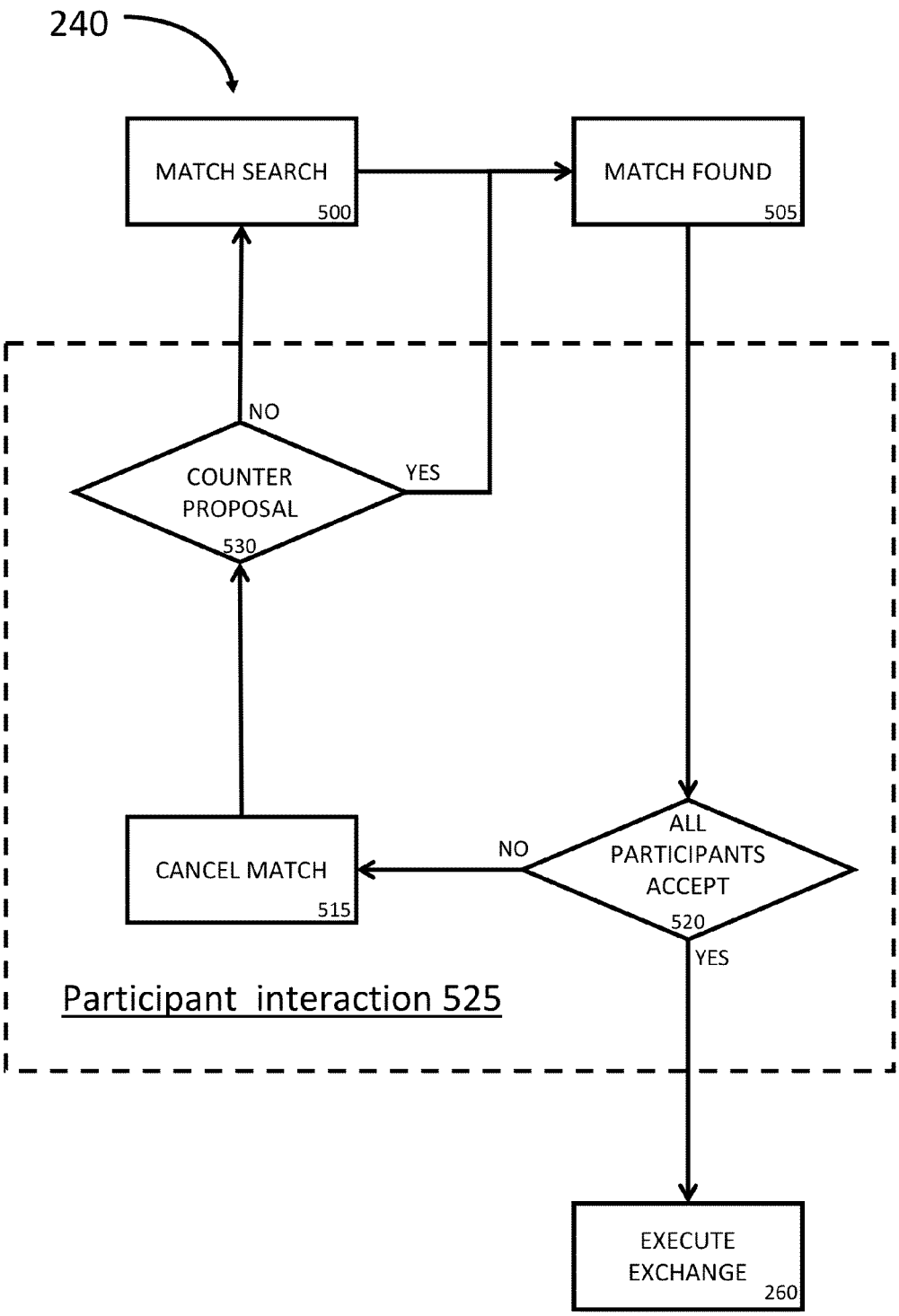
FIG. 5 is a flow chart illustrating a method for matching offers to exchange semi-fungible goods and services, according to embodiments of the present disclosure.

Following the acceptance, creation, or modification of an offer 430, the matching process 240 begins. This process is detailed in FIG. 5. The search for potentially matching offers 500 may be accomplished by either the system or by individual participants. A system search is initiated when changes are made to either the offer database 120 or inventory database 130. The processing system 110 compares offer requirements contained in the offer database 120 to product data contained in the inventory database 130. When the criteria for two or more offers and their associated products are fully satisfied, a potential match has been found 505. At this time the offer database 120 and inventory database 130 may be updated to reflect that a potential match has been identified.

As an alternative to a system match, individual participants may identify and accept existing offers without creating offers of their own. Acceptance of an existing offer 405 creates an implicit match 505 between two or more offers.

If no potential matches are identified by either the system or participants, the system can continue to search for new potential matches every time a change occurs in either the offer database 120 or the inventory database 130. During this time, participants may continue to interact with the market by creating new offers, modifying or deleting offers they have previously created, or accepting offers created by other participants.

The amount of time available for any particular product exchange may be defined by the nature of the product, the market maker, or the participants involved. For example, sporting events, airline tickets, hotel rooms and music concerts are all associated with a specific time, and exchanges can not occur once the time associated with these products has past. Additionally, for certain products, some time buffer may be required for final product processing, preparation or customer service and so the available processing window for the exchange may be less than the theoretical maximum. In other cases, the market maker may wish to artificially limit the amount of time available for product exchanges in order to constrain market volume, support customer service or to limit exchange activity in a specific way. Finally, the participants themselves may desire to limit the amount of time that their products are available for exchange.

When a potential match is found 505, participant preferences regarding system interaction are checked. These preferences were either previously selected by participants 425 during the offer creation process 430 or may have been fixed by the system at a market level.

If all participants involved in a potential match have opted to allow the system to process their potential matches, no further participant action is required. The system will recognize that all participants implicitly accept the potential match 520, and will proceed with executing the exchange 260.

When one or more participants involved in a potential match have selected manual processing, participant interaction is required 525. In this case, each participant will need to review and approve the potential match. When any given participant accepts the potential match, the system can record this approval and continue to collect participant approvals until all participants have approved the match 520. Once all participants have approved of the potential match, the exchange can be executed 260. However, if any participant rejects the potential match, the match process can be cancelled 515.

In certain embodiments, a participant may be allowed to propose a counteroffer when an potentially matching offer is declined 530, creating a new potentially matching offer cycle. For example, consider a participant who is looking to exchange his premium concert ticket for another of lesser quality for $50. It is possible that he rejects a potential match due to the extremely poor quality of the other ticket. In response, the owner of the second ticket may choose to create an immediate counter-offer, raising the compensation level to $100. This new offer would represent another potential match 505, and a new potential offer cycle could begin.

If a potential match is cancelled 515 by a participant and no counteroffers are created, the system may return to searching for potential matches 500.

Figure 6:
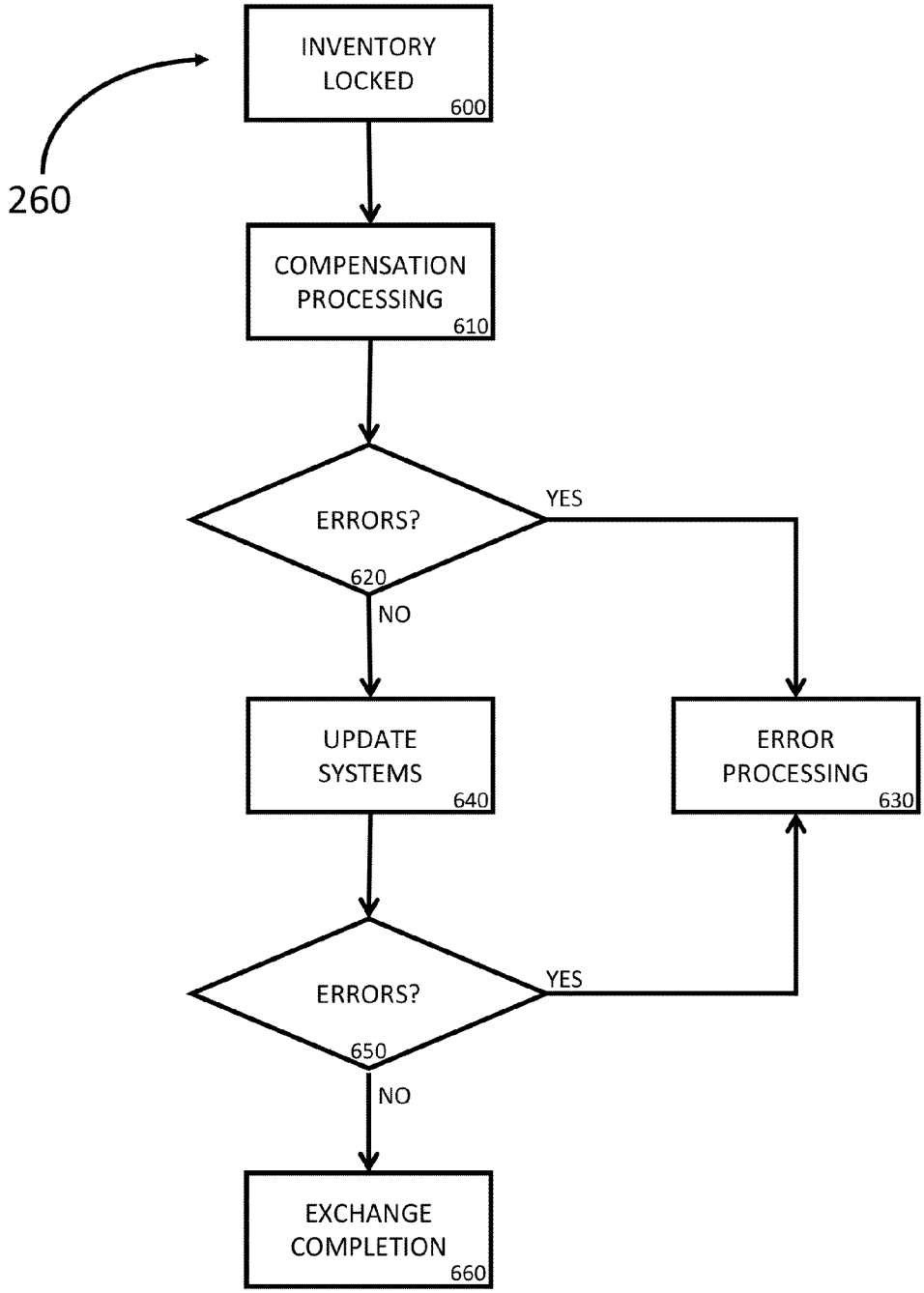
FIG. 6 is a flow chart illustrating a method for executing the exchange of semi-fungible goods and services, according to embodiments of the present disclosure.

FIG. 6 provides more detail on the execution of an exchange 260 from FIG. 2. At the start of the exchange execution process, all involved products are locked 600, preventing the execution of any competing offers until the offer set under consideration is either executed or cancelled. Any number of well-understood methods may be used for locking products in the inventory database 130 in order to prevent interference from other active processes.

Compensation processing 610 follows, where funds and/or other assets are debited and credited as necessary in participant accounts. It is possible that errors may occur 620 during this process. For example, the systems that control a participant's assets may be temporarily unavailable or report that insufficient funds exist to cover the requested transaction.

If errors are identified 630, the exchange process may be delayed or cancelled. Any partially completed compensation transfers can be rolled back, involved participants can be notified of the cancellation, and participant product inventory may be unlocked to immediately allow for additional potential matches.

Depending upon the nature of the error received, a number of additional actions may take place. If the error is temporary in nature; for example, if a certain external system is temporarily unavailable, the impacted product may be held in a locked state until the error is resolved. If the error is related to a potential fraud or security problem, all products linked to the participant's account may be locked until the issue is resolved. This process may involve updating the participant database 140 with additional information regarding the errors received.

Following successful compensation processing, the remaining internal and external systems may be updated 630 to complete the exchange process. These include systems-of-record, the official repositories of electronic product ownership. Systems-of-record may include proprietary databases, airline, cruise and hotel computer reservation systems, or any other database or computer used to electronically record, in an official manner, ownership of the involved products.

Error checking 650 is also performed at this stage. It is possible that certain systems may be unavailable or may report data discrepancies. For example, an external system-of-record may report that one participant no longer retains ownership of a product in question. If any errors are found, appropriate error processing 630 takes place.

Differences in system architectures may dictate that compensation processing 610 and system updates 640 take place in reverse order or simultaneously.

Once compensation processing 610 and system updates 640 are completed without errors, the exchange is completed 660. This final step may involve participant notification and any necessary data maintenance, logging and archiving. Participant notification may include any additional information necessary for participants to successfully claim or utilize their new product(s) and/or compensation. It is not necessary that all system activities fully complete prior to participants claiming their products and compensation; certain tasks related to maintenance, record keeping or other low priority tasks may be performed at a later time.

Illustration of Offer Process: Single Participant Creating Single Offer

Consider a student who purchases an airline ticket for $700 to fly from New York to London. The ticket is purchased far in advance of the actual departure date and represents a good value for our price-sensitive student. Our student also happens to be fairly flexible in her travel plans, and doesn't mind altering her plans in order to recoup some of the cost involved. As a result, our student decides to participant in the exchange process.

Our student enters the system 200 through an application on her cell phone 100, and reviews the current market for her ticket 400. She is not surprised to learn that there are no offers on her flight; after all, her ticket has been booked well in advance and it's likely that only a small number of seats have been sold by the airline. However, she also learns that on similar flights in the past, many successful exchanges have taken place, and that in the week prior to departure, exchanges have involved compensation exceeding $300.

Since there are no existing offers for our student to consider 405, she opts to create one of her own. Her participant data was previously collected and stored in the participant database 140 when she registered using her cell phone application.

FIGS. 7A, 7B and 7C describe a potential subset of data associated with our student's offer. FIG. 7A represents potential contents of the participant database 140, FIG. 7B represents potential contents of the inventory database 130, and FIG. 7C represents potential contents of the offer database 140.

In FIG. 7A we see the portion of the participant database 140 that includes her participant ID number 701, first name 702, last name 703, her type of compensation account 704, her encoded compensation account number 705, her airline frequent flier program 706, her encoded frequent flier account number 707, her e-mail address 708 and her securely encoded password 709.

Her product data is transferred directly from her airline's reservation system to the inventory database 130. In FIG. 7B we see the portion of the inventory database 130 that includes her seat position 711, seat row 712, carrier 713, flight origin 714, flight destination 715, departure date 716, flight number 717, and the system-of-record 718 that maintains the official, formal record of her product ownership.

Our student proceeds to select the criteria for her desired exchange 415. She is willing to accept a wide range of products in a potential exchange. She's willing to sit in any type of seat, in any row. She's willing to travel on a different airline and leave any time of day. She's also willing to leave from either of two New York airports (JFK or LaGuardia), and is even willing to alter her departure date by a few days.

In return, our student determines that she would like compensation 420 of $150. This is represented by an ask offer. Finally, our student selects her preferences for interacting with the system 425. She opts to allow for automatic processing of her offer, given that she is relatively indifferent to the possible exchanges that meet her criteria.

In FIG. 7C we see the portion of the offer database 120 that includes her offer criteria. These criteria include seat position 721, seat row 722, carrier 723, origin 724, destination 725, departure date 726, flight number 727, and exit row seating 728. It also contains her $150 ask offer 730 and no bid offer 729. Finally, it also contains her preference for automatic match processing 731.

Time passes. Two weeks prior to our student's departure, a family books three tickets on the same flight. They are disappointed to find that they are unable to sit together. After purchasing three seats in three different areas of the plane, they enter the exchange system 200 through their home computer 100. Viewing existing offers 400, they do not immediately identify a match and so they allow the system to find a potential match for them. This involves creating an offer 430 that specifies they are looking for a group of three seats next to each other. They are willing to pay $300 for the total exchange and opt to allow the system to execute any matching offers automatically.

After the family creates their offer, the system begins the match search process 500 by looking for all possible combinations of offers that provide the family with a set of three contiguous seats. It finds a match 505 by combining our student's offer with two other participant offers. The combined ask price for these three seats is $280: $150 from our student, $100 from a second offer, and $30 from a third offer.

All four involved participants opted to allow for automatic processing. This allows the system to infer approval from all parties 520 and allows the system to begin the exchange process 260.

The six tickets (three from the family, one from our student and two from two other participants) associated with this exchange are locked 600, preventing interference from any other active offers. During the brief period of time it will take the system to process the exchange, it will not be possible for any additional action to be taken on these specific products. The compensation processing 610 occurs without errors 620.

All systems-of-record are updated 640 without errors 650. In the case of our student, her system-of-record is her airline's computer reservation system (CRS). In order to process the compensation transfer required of this exchange, the family's credit card is debited for $280, our student's PayPal account is credited for $150, and the other two participant accounts are credited for $100 and $30. After this process is complete, all four participants receive confirmation 660 that the exchange has been successfully completed.

Illustration of Offer Process: Single Participant Creating Multiple Offers

To illustrate the creation of multiple offers on a single product, consider a business traveler who purchases an airline ticket for $995 to fly from San Francisco to New York. Our traveler likes to work during long flights and is disappointed he isn't able to use his frequent flier status to upgrade to first class. Instead, his ticket is for a middle seat. He knows that he might be able to change his seat when he checks-in at the airport, but would prefer to obtain an aisle seat in advance in order to completely eliminate the risk of having to spend five hours in a middle seat. Our traveler also has an abundance of frequent flier miles, and wouldn't mind giving up a few of them in order to obtain a guaranteed aisle seat.

However, our traveler also knows from experience that this particular flight is often sold out and many other business travelers are forced to take a much less convenient flight either earlier or later in the day. Someone in this situation may be willing to pay a substantial sum in order to exchange tickets with him. For the right price, our traveler is willing to sacrifice the convenience of his current flight.

Our business traveler enters the system 200 through his airline's frequent flier website 100 and views the current market for flights between San Francisco and New York 400. He does not have the time to review existing offers 405 and decides to simply create two new offers 430.

All of our traveler's data was previously either entered by him when he first registered with the exchange system or collected and transferred by his airline's reservation system, so he does not need to enter any additional information at this time.

FIG. 7D illustrates the portion of the participant database 140 that contains our traveler's identification number 741, first name 742, last name 743, type of compensation account 744, encoded compensation account number 745, airline frequent flier program 746, encoded frequent flier account number 747, e-mail address 748 and encoded password 749.

FIG. 7E illustrates the portion of the inventory database 130 that contains information about our traveler's product. It includes his seat position 751, seat row 752, carrier 753, flight origin 754, flight destination 755, departure date 756, flight number 757, and the system-of-record 758 that maintains the official, formal record of his ownership of this product.

The first offer that our traveler creates is focused on exchanging his middle seat for an aisle seat. For his exchange criteria 415, he is not willing to fly on any other airline, since that might risk his opportunity for a first class upgrade. In terms of compensation 420, he's willing to give up 2,500 frequent flier miles for this exchange. In order to maximize the probability that this offer is identified and processed quickly, he opts for automatic processing 425.

In FIG. 7F we see the portion of the offer database 120 that contains the data related to this first offer. It includes his criteria for seat position 761, carrier 762, flight number 763, departure date 764 and his 2,500 mile bid offer 765. It also contains his preference for automatic match processing 767.

Our business traveler also creates a second offer in order to monetize the value of his current seat. For this offer, his exchange criteria 415 still requires that he remain on the same airline, but provides flexibility in terms of departure time and seating location. He is willing to leave either earlier or later in the day and is willing to accept either an aisle or window seat. He asks $700 for this exchange 420. He doesn't specify any other criteria, and chooses to manually review 425 any matching offers.

In FIG. 7G we see the portion of the offer database 120 that contains the data related to the second offer. It includes his criteria for seat position 771, carrier 772, flight time 773, departure date 774 and $700 ask offer 775. It also contains his preference for manual match processing 776.

As our business traveler enters his two offers, the system begins to search for potential matches 500 but does not find any. It continues to search for matches as new offers are added to the market and existing offers are modified.

After a few hours, another business traveler on a later flight to New York enters the system 200 and sees our business traveler's second offer 400. This traveler likes the idea of taking a more convenient flight and decides to accept this offer 405.

Because our first traveler opted to manually review potential matches on this offer, he receives an alert on his smart phone 100 that a potential match exists. He enters the system 200 through his smart phone 100 and reviews the latest marketplace data 400 which includes information regarding the potential match. He sees that the seat being offered to him is towards the back of the plane and is an aisle seat. After considering this offer, he decides to accept 405.

The system recognizes that the search process 500 and match identification process 505 are both complete and that all involved participants have accepted the potential match 520. The exchange process is initiated by locking the two involved tickets 600 in the inventory database 130, preventing any additional activity from taking place.

Compensation processing 610 takes place. Our traveler's Visa account is credited for $700 as the second participant's account is debited for $700. No errors occur 620, and the systems-of-record associated with each product are updated 640. For our traveler, his airline reservation system is updated with the new ticket data. Again, no issues or errors are identified 650 and the two participants receive e-mail and text message confirmations regarding the successful exchange 660.

As part of final exchange processing, both offers created by our business traveler are removed from the offer database 120 along with the offer created by the second participant. Both tickets are also removed from the inventory database 130.

Matching Process: Two-Way Product Exchange

Figure 8A:
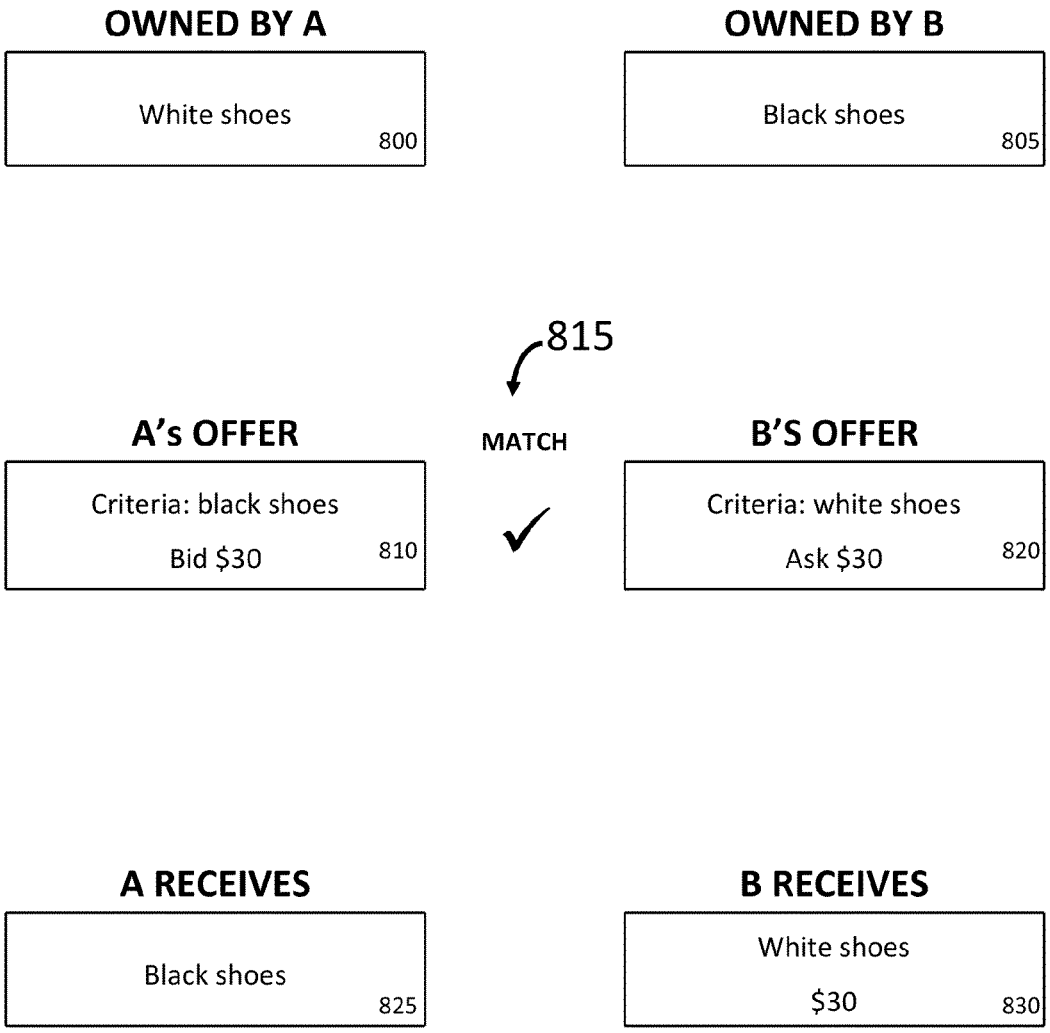
FIG. 8A is a diagram illustrating a two party exchange of semi-fungible goods, according to embodiments of the present disclosure.

To further illustrate the logic involved in the matching process 240, consider FIG. 8A, which illustrates the basic data involved in a two-party exchange. The first participant, A, owns a pair of white shoes 800 but would like a pair of black shoes for an upcoming evening event. Participant A is willing to pay $30 in order to exchange their white shoes for a pair of black shoes 810 (a bid offer). The second participant, B, owns a pair of black shoes 805. Participant B may, in fact, own many pairs of black shoes and would be willing to exchange one pair for a similar pair of white shoes if $30 in compensation 820 were offered (an ask offer). For simplicity, we can assume that all other product attributes shared by the two pairs of shoes (size, brand, condition, etc.) are identical.

When these two offers and their associated products are compared, we can see that they satisfy each other and represent a match 815. Participant A wants black shoes, participant B has black shoes. Participant B wants $30, participant A is willing to pay $30. These two offers represent a potential match. Executing this exchange will result in our two parties exchanging products. Participant A will receive a pair of black shoes 825, and participant B will receive a pair of white shoes plus a $30 payment 830 from participant A.

Potential applications of this disclosure may involve many more data elements, but the same approach to matching logic can be used. For example, an offer to exchange a train ticket may contain the following criteria:

1. Origin
2. Destination
3. Departure Time
4. Day of Departure
5. Seat Position (Aisle, Window, Middle)
6. Position of Train Car (Front, Middle, Back)
7. Food Car (Yes or No)
8. Sleeper Car (Yes or No)
9. First Class (Yes or No)

Despite the increased number of product attributes and corresponding offer criteria, two train offers with all of the above criteria can be evaluated in the same straightforward manner by testing each individual criterion. If all product and compensation criteria are met, the two offers represent a potential match.

To capture the preferences of a more sophisticated participant, offer criteria may involve ranges and logical operators such as AND, NOT and OR. For example, an offer to exchange train tickets using the above criteria may involve criteria such as:

1. Monday, Tuesday or Wednesday departure with a Sleeper Car.
2. Thursday or Friday departure with First Class and Food Car, but not departing before 9 AM.
3. Saturday or Sunday departure with First Class and Food Car, departing between 1 PM and 5 PM
4.

Matching Process: Two-Way Product Exchange Across Time

Figure 8B:
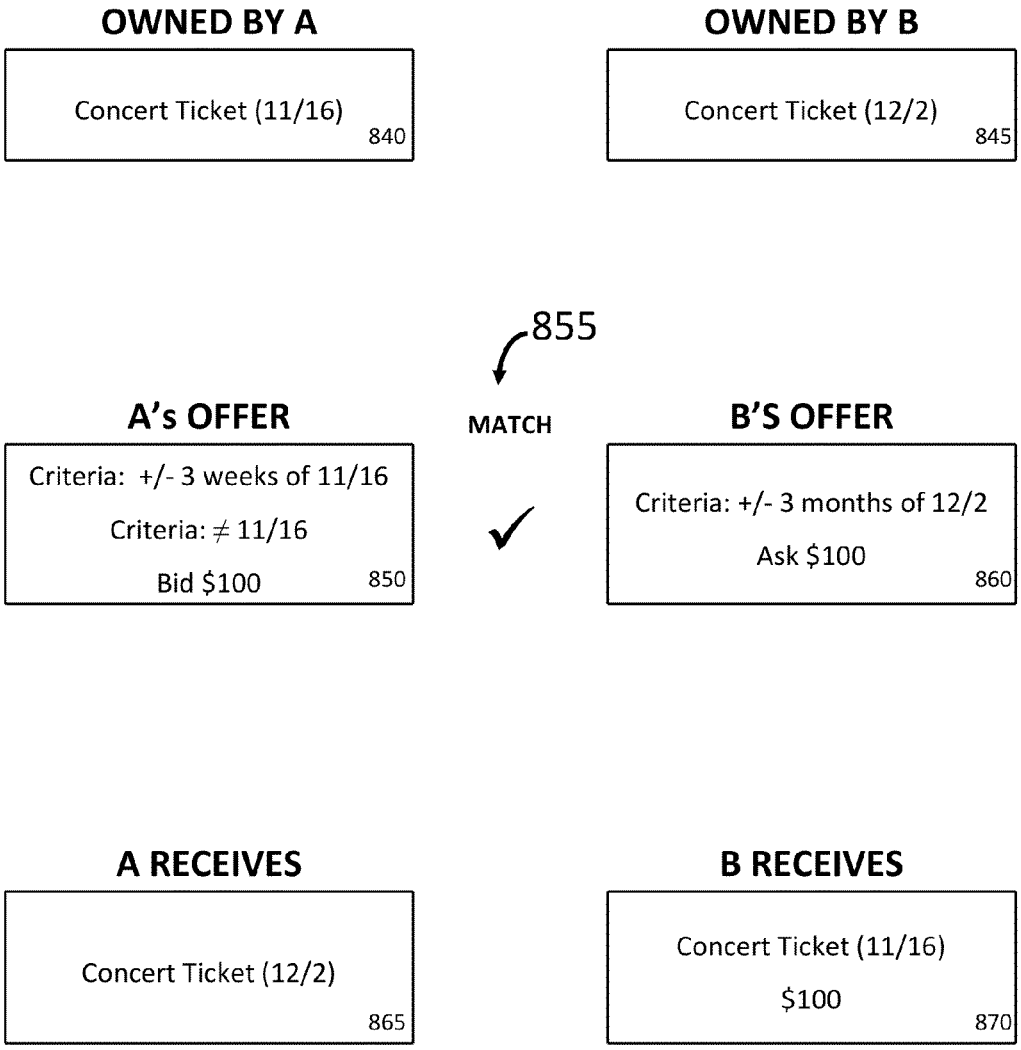
FIG. 8B is a diagram illustrating a two party exchange of semi-fungible goods, according to embodiments of the present disclosure.

While many semi-fungible products being exchanged may exist within the same timeframe, this is not necessary. FIG. 8B provides an example of a successful product match where the two products exist in different time periods.

In this example, participant A is in possession of a November 16$^{th}$ concert ticket 840. Due to a conflicting event, participant A is unable to attend the concert on this date but would still like to see the performance on another date. Knowing that there are a series of concerts by this same performer, our participant wants to exchange his ticket for one within three weeks of November 16$^{th}$. Of course, he does not want to exchange his ticket for one on November 16$^{th}$, so this date needs to be excluded from his consideration set. As long as these date criteria are fulfilled, participant A is willing to offer $100 for an exchange 850.

A potentially matching offer is provided by participant B, who is seeking to monetize the value of his ticket. Participant B has a ticket for December 2$^{nd}$ 845, but is indifferent as to when he actually attends the concert. Participant B realizes that others may value trading tickets with him, and he is offering to exchange his ticket for $100 as long as the date is within three months of December 2$^{nd}$ 860.

Comparing these two offers and their related products, we can see that they mutually satisfy each other and represent a potential match 855. If the match is approved and executed successfully, participant A will receive a concert ticket for December 2$^{nd}$ 865. Participant B will receive a concert ticket for November 16$^{th}$ along with $100 870 from Participant A.

Matching Process: Three-Way Product Exchange

Figure 8C:
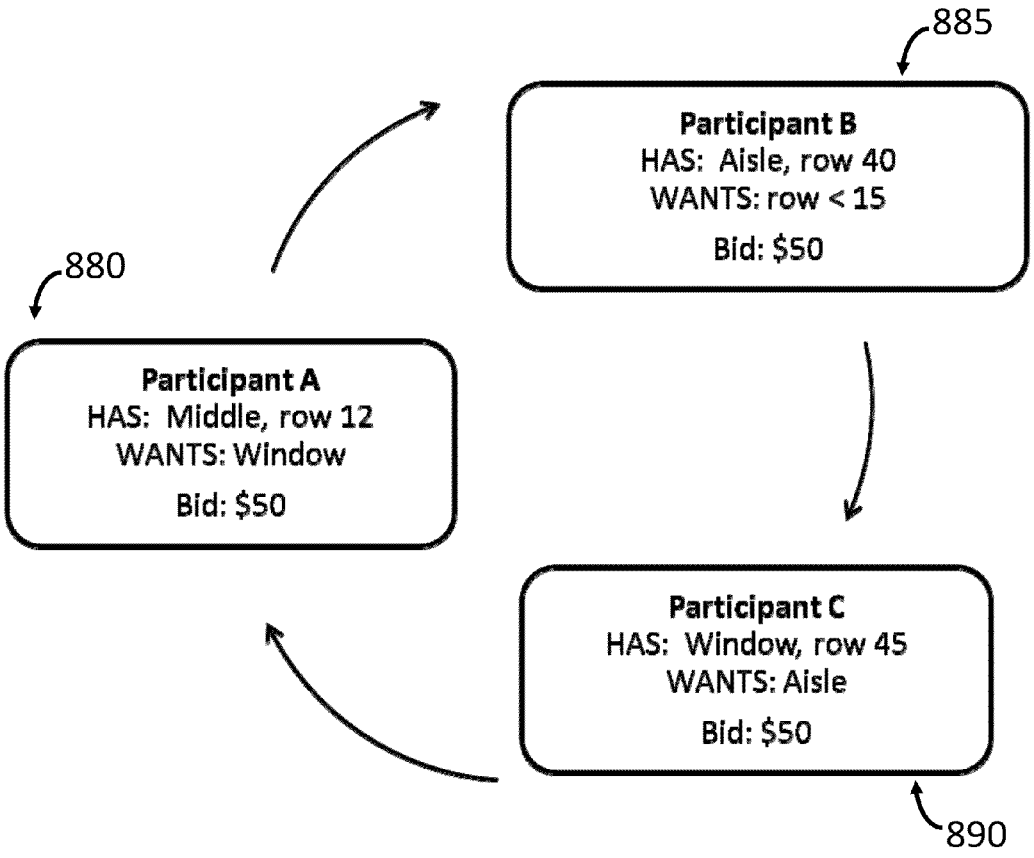
FIG. 8C is a diagram illustrating a three party exchange of semi-fungible goods and services, according to embodiments of the present disclosure.

One of the benefits of allowing an automatic match process is the increased potential for identifying multi-party matches. FIG. 8C illustrates the logic involved in a three-party exchange of airline tickets.

In this example, participant A has a middle seat in row 12 and is willing to pay $50 for a window seat anywhere else on the plane 880. Participant A is attempting to upgrade his product for one that he finds more appealing.

Participant B has an aisle seat in row 40 and is willing to pay $50 for any seat below row 15 885. Participant B is driven by a need to make a tight flight connection and wants to reduce the risk of being stranded at a connecting airport. By moving his seat towards the front of the plane, he believes he will be able to exit the plane more quickly and improve the odds of making the connecting flight. Participant B is upgrading his product for one that reduces his risk.

Participant C has a window seat in row 45 but prefers aisle seating and is willing to pay $50 for an exchange 890. Like participant A, participant C is attempting to upgrade his product for one that he finds more appealing.

Within this set of three offers, there are no two offers that fulfill each other's requirements. Each individual participant, searching for offers on their own, may be unable to find one that meets their needs. However, at a system level we can easily structure a three-party exchange where all parties are fully satisfied. If A's seat is given to B, B's seat is given to C, and C's seat is given to A, all offer requirements are completely satisfied and we have found a potential three-way match.

In this scenario, all three participants happen to offer $50 as a bid price. Once all three offers are successfully matched, the compensation requirement nets to zero and no actual compensation exchange is required.

Transaction Fees

For simplicity's sake, the above examples do not illustrate transaction fees. However, market mechanisms commonly require these fees to fund the market infrastructure and generate profits for market administrators. These fees are typically based on either a percentage of the value being exchanged, a flat fee based on the volume of transactions, or a combination of both. Fees may be paid by one or more of the participants involved in an exchange.

Figure 8D:
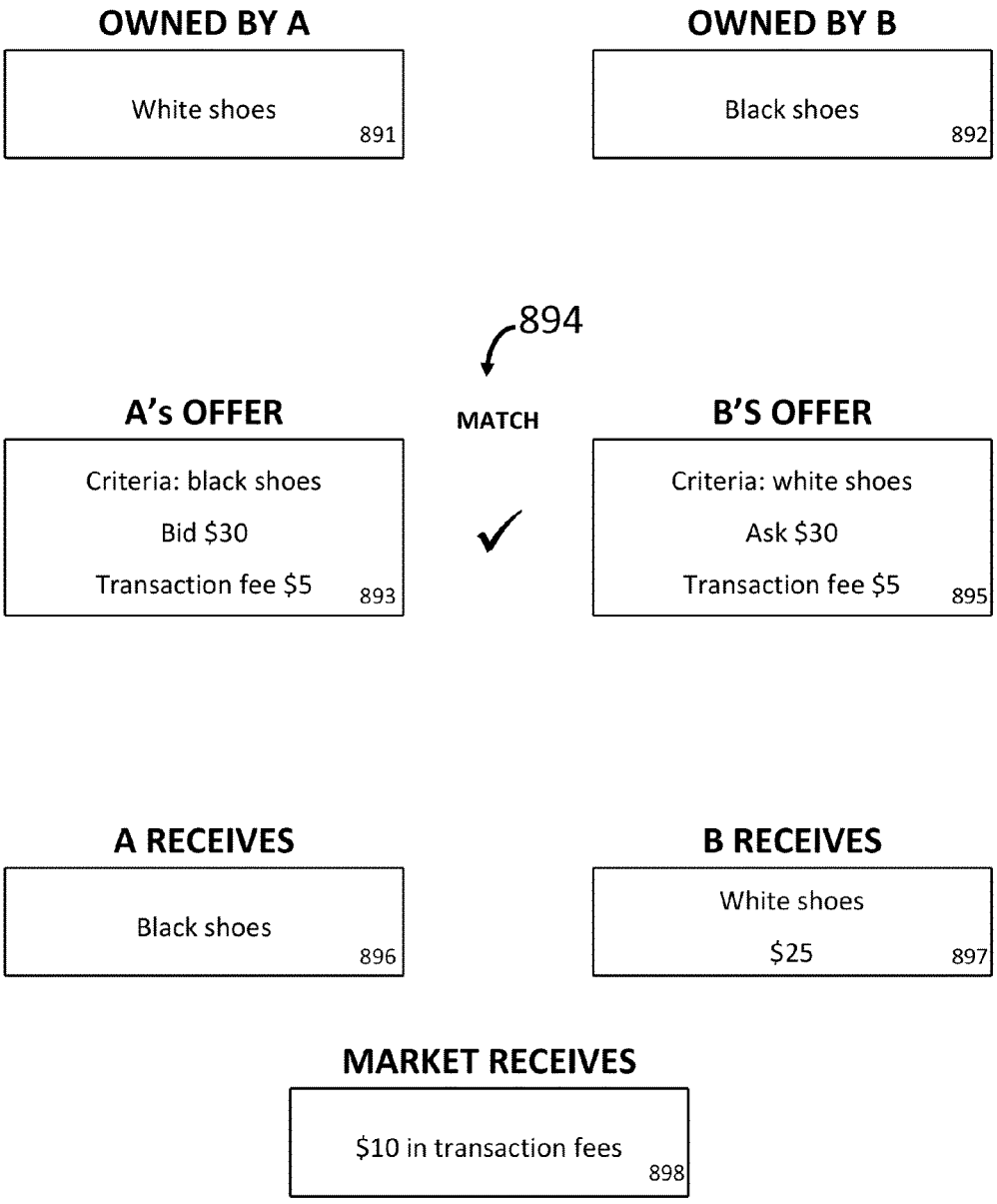
FIG. 8D is a diagram illustrating a two party exchange of semi-fungible goods, according to embodiments of the present disclosure.

FIG. 8D expands the example of FIG. 8A to include transaction fees. Once again, participant, A owns a pair of white shoes 891 but would like a pair of black shoes. This particular market requires a flat $5 transaction fee paid to the market maker. Participant A's complete offer consists of a desire to exchange her white shoes for a pair of black shoes, a willingness to pay the other party $30, and a willingness to pay the market a $5 transaction fee 893.

The second participant, B, owns a pair of black shoes 892. Their offer consists of a willingness to accept an exchange for a pair of white shoes plus $30 from the other party and a willingness to pay the market a $5 transaction fee 895.

When the criteria of these two offers are compared, we can see that they satisfy each other and represent a match 894. Executing this exchange will result in our two parties swapping products. Participant A will receive a pair of black shoes 896, participant B will receive a pair of white shoes and a net payment of $25 897. The market will receive $10 in transaction fees 898, $5 from participant A and $5 from participant B.

Business-to-Business Process Perspective

The above examples explored the exchange process from a consumer-centric perspective. In fact, the same process can be used for a business-to-business product exchange. While the process itself remains unchanged, the nature and motivations of the participants can differ.

To illustrate a business-to-business exchange opportunity, consider two companies who produce different products that happen to share some semi-fungible materials or components. These companies may have no clear view of long-term market demand for their output, but at some point in time are able to predict near-term demand with a reasonable degree of accuracy.

There are many real world examples of this dynamic. Consider manufacturers that produce electronic goods for the retail market. Any given manufacturer may have some general idea of what next year's demand may look like, but it is not until their sales teams lock in agreements with retailers that they are able to forecast future sales with any degree of accuracy. Additionally, in this industry just-in-time (JIT) orders are commonplace, giving manufacturers little time to react to changes in demand. While a just-in-time supply chain may benefit the extended manufacturing ecosystem, it may also place increased pressure on manufacturers to carefully manage their material inventory levels.

Operating in this type of environment, companies may be expected to create advance orders for key materials and components where supply is uncertain. Manufacturers of electronic goods may place advance orders for touch-sensitive glass displays, processors, and other key sub-assemblies. Aerospace and defense contractors may place advance orders for specific types and classes of titanium and carbon composites. Food manufacturers may place orders for difficult to procure seasonal ingredients.

This type of advance planning assures manufacturers that they will be capable of a certain minimum level of output. Of course, given the variable nature of supply and demand, it is unlikely that a manufacturer will ever develop a series of perfect orders. Most of the time, as demand becomes more visible, manufacturers will find that they have either too much or too little of what they need. When these errors can be balanced out across companies, an exchange of advance orders may benefit both organizations.

In FIG. 9, we return to our two company example and illustrate how this might occur in a quantitative way. Company A has assumed a ramp-up in demand across its four planning periods 900 beginning with 100 units in period 1 and ending with 400 units in period 4, for a total demand of 1,000 units. Company A places advance orders 905 using this assumption. Unfortunately, some time later it obtains a clearer picture of future demand, and now believes that it will experience flat demand of 250 units across all four planning periods 910. While the total demand estimate of 1,000 units happens to be precisely correct, this does not allow the company to avoid overages and shortfalls in every period 915. Most importantly in terms of near-term revenue, a shortfall of 150 units will occur in period 1 and a shortfall of 50 units will occur in period 2. Assuming that Company A's supplier has constraints of its own and there is no extra inventory available, Company A may not be able to meet customer demand in periods 1 and 2.

This is in contrast to Company B's situation, where in every time period 920, their advance orders 925 are consistently below their revised demand forecast 930. If this situation is not addressed, Company B will be left with an overage of 100 units in all four planning periods 935. At best, this excess will absorb valuable working capital. At worst, the material may become obsolete after some time and could represent a complete write-off expense.

In this example, Companies A and B can benefit each other by exchanging advance material orders. Company A would like to obtain 100 of Company B's extra units in period 1 940 and 50 of Company B's extra units in period 2 945. While this does not completely address either company's problem, it does leave them better off than they would be otherwise.

This example of an exchange between two manufacturing entities is simplified. Many manufacturer markets consist of hundreds or thousands of companies that may share thousands of inputs. One practiced in the art will appreciate that once the size of the market is combined with the potential for three-way or four-way exchanges, attempting to identify potential exchanges without the benefit of a supporting exchange infrastructure is impractical.

While specific implementations and hardware/software configurations have been illustrated, it should be noted that other implementations and hardware configurations are possible and that no specific implementation or hardware/software configuration is needed. Thus, not all of the components illustrated may be needed for implementing the methods disclosed herein.

The above described embodiments are intended to illustrate the principles of the invention, but not to limit the scope of the invention. Various other embodiments and modifications to these preferred embodiments may be made by those skilled in the art without departing from the scope of the present invention.

What is claimed is:

1. A method for exchange of tickets, the method comprising:

electronically receiving, using a computer based processing system, a plurality of offers from a plurality of participant devices of a plurality of participants, each offer comprising a plurality of parameters related to the offer, including an identification of a ticket to be offered and an identification of a system of record for the ticket, wherein each system of record is remote from the computer based processing system and is controlled by a ticket issuing authority that records official ownership of tickets;

storing the plurality of offers in an electronic database;

matching, using the computer based processing system, a first offer from the plurality of offers and a second offer from the plurality of offers based on the parameters of the plurality of offers; and executing, using the computer based processing system, an exchange of the tickets identified in the first offer and the second offer, based on the parameters of the first offer and the second offer, wherein executing the exchange comprises:

electronically notifying each of the participants of the first offer and the second offer;

locking the first offer and the second offer in the electronic database;

sending an electronic request to a first system of record and a second system of record, different from the first system of record, wherein the electronic request instructs each of the first and the second systems of record to execute the exchange; and in response to at least the first and the second systems of record updating official ownership of one or more tickets identified in the first offer and the second offer, notifying each of the participants of the first offer and the second offer that the exchange is complete.

2. The method of claim 1, wherein the matching comprises matching the first offer and the second offer with at least a third offer.

3. The method of claim 1, wherein the parameters comprise a date, a time, a location, or a payment.

4. The method of claim 1, wherein the matching and executing are performed automatically.

5. The method of claim 1, wherein at least one of the matching or executing are performed manually.

6. The method of claim 3, wherein the payment comprises money, loyalty points, or loyalty miles.

7. The method of claim 6, wherein the executing of the exchange comprises processing the payment.

8. The method of claim 1 comprising receiving a plurality of participant preferences from the plurality of participant devices.

9. The method of claim 8, wherein the executing of the exchange comprises checking the plurality of participant preferences.

10. The method of claim 1 comprising:

providing an offer database stored in a computer readable medium, the offer database comprising a plurality of existing exchange offers for semi-fungible goods or services, the existing exchange offers comprising a set of parameters, including an identification of a semi-fungible good or service;

electronically receiving a query from the user of one or more of the existing exchange offers in the offer database;

electronically providing results of the query comprising one or more existing travel reservation offers; and if the user designates a resulting travel reservation offer as acceptable based on the query, then electronically receiving an exchange request from the user to execute an exchange based on the resulting travel reservation offer designated as acceptable; and electronically executing the exchange request automatically.

11. The method of claim 1, wherein the plurality of participants comprise businesses.

12. The method of claim 1 comprising electronically receiving a modification of an existing offer in the electronic database from one of the plurality of participant devices.

13. The method of claim 1, wherein the parameters of at least one offer comprise an expiration date to limit a timeframe of the at least one offer.

14. The method of claim 13 comprising determining if the timeframe of the at least one offer has expired.

15. The method of claim 1 comprising electronically receiving a counter offer from one of the plurality of participant devices.

16. The method of claim 15, wherein the counter offer comprises modified parameters of an original offer.

17. The method of claim 1 comprising electronically receiving modifications for an existing offer in the electronic database from at least one participant device from the plurality of participant devices.

* * * * *